United States Patent [19]

Mooney

[11] Patent Number: 4,934,081

[45] Date of Patent: Jun. 19, 1990

[54] RETAINER FOR REVOLVER YOKE STUD

[75] Inventor: Joseph S. Mooney, Warren, Mass.

[73] Assignee: Smith & Wesson Corp., Springfield, Mass.

[21] Appl. No.: 387,124

[22] Filed: Jul. 31, 1989

[51] Int. Cl.[5] ..... F41C 3/14

[52] U.S. Cl. ..... 42/62; 267/179

[58] Field of Search ..... 42/62, 59; 267/179, 267/166

[56] References Cited

U.S. PATENT DOCUMENTS

| | | | |
|---|---|---|---|
| 517,152 | 3/1894 | Wesson | 42/62 |
| 667,248 | 2/1901 | O'Neill | 42/62 |
| 1,411,800 | 4/1922 | Molloy | 42/59 |
| 2,329,273 | 10/1939 | Kelly | 42/62 |
| 2,382,676 | 4/1943 | Swartz | 42/62 |
| 3,207,010 | 9/1965 | Wendling | 267/179 |

OTHER PUBLICATIONS

American Rifleman, "Ruger Redhawk", Feb 1984.

Colt; Python Instruction Manual; December 1981; Parts Illustration.

*Primary Examiner*—Charles T. Jordan
*Assistant Examiner*—Michael J. Carone
*Attorney, Agent, or Firm*—Chapin, Neal & Dempsey

[57] ABSTRACT

A retainer for a revolver yoke stud includes a screw portion with spring and pin detent carried thereby in a unitary assembly. The yoke stud includes an angular groove with a chamfered surface adapted to be engaged by the tapered end of the pin. The frame of the revolver is provided with a threaded bore and a hole in its plate aligned with the chamfer of the stud when the yoke is disposed in operative position in the revolver. The screw serves the dual function of a fastener for the side plate and as the base or mounting member for the spring detent assembly. The screw and pin include oppositely opening tubular recesses and the pin is adapted for axial movment with respect to the screw member. The outer ends of the spring are enlarged to be captured and retained in the opposed tubular recessed of the screw and pin, thereby forming a unitary assembly.

4 Claims, 2 Drawing Sheets

Fig. 1.
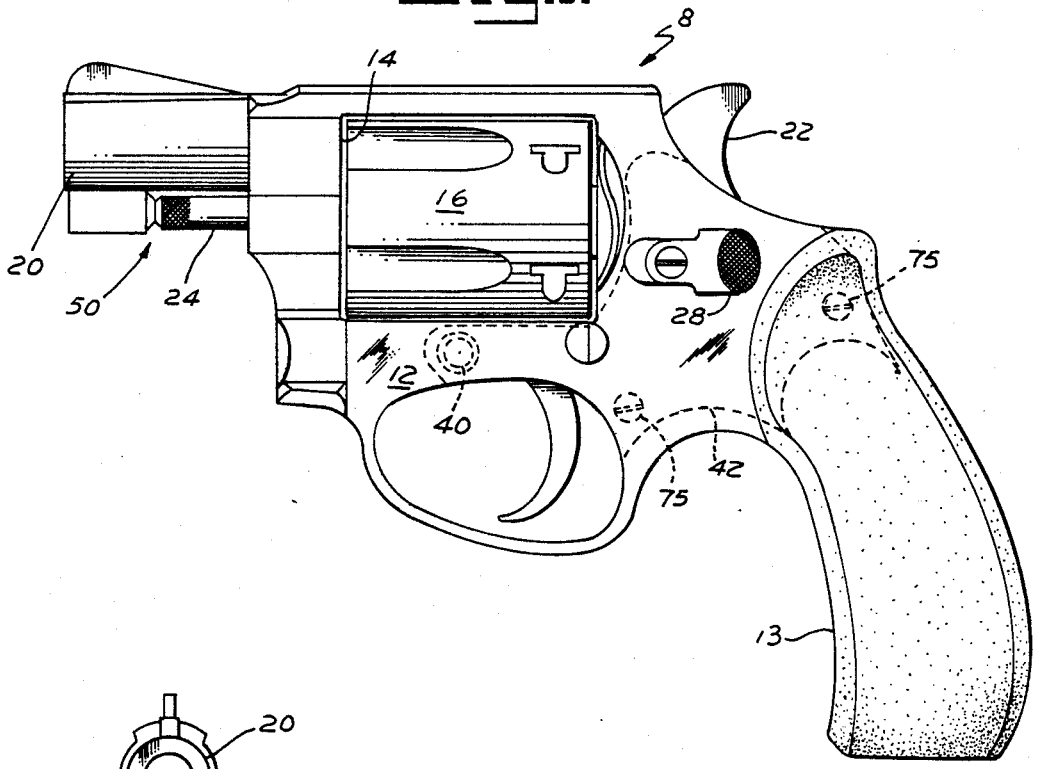
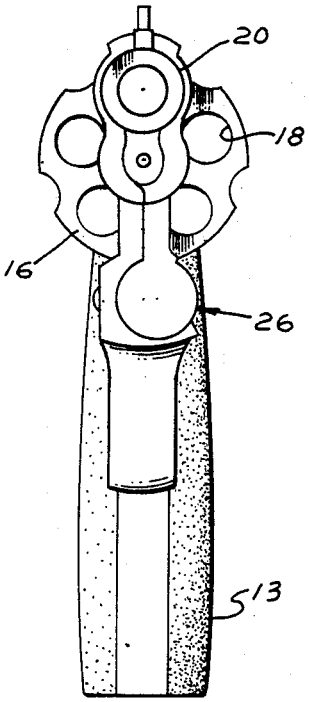
Fig. 2.
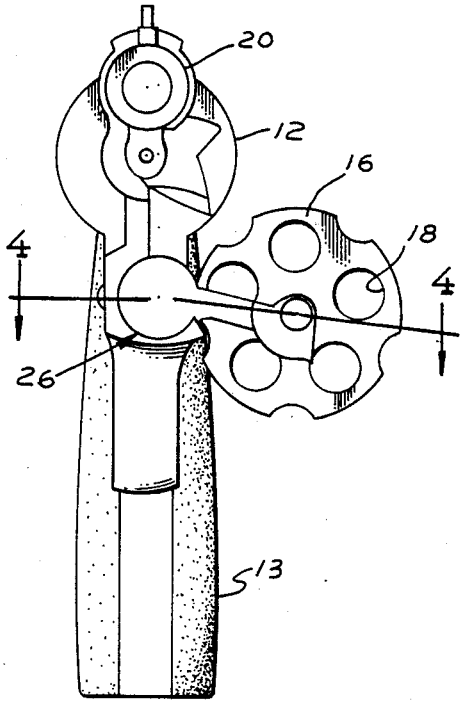
Fig. 3.

RETAINER FOR REVOLVER YOKE STUD

BACKGROUND OF THE INVENTION

This invention is directed to means for retaining the pivotable yoke of a revolver on the frame and, more particularly, to a unitary retainer which also applies a spring drag on the pivotable movement of the revolver yoke.

Prior art yoke screws extend through the side of the frame to engage with a recess in the yoke. The purpose of these screws is simply to retain the yoke in its operative position while permitting rotation thereof. Examples of such yoke restraining screws are shown in U.S. Pat. No. 2,382,676 to Swartz and No. 2,379,273 to Kelly.

In addition, Colt Industries manufactured and sold revolvers in 1981 which included a crane lock detent, spring and lock screw. While this detent arrangement served to impart a spring drag or restraint on the cylinder operation, the component did not form a unitary assembly. In addition, the yoke screw did not extend through the side plate to serve as fastener means.

The principal object of this invention is to provide combination yoke retaining detent, spring and side plate screw as a unitary assembly.

The above and other objects and advantages of this invention will be more readily apparent from the following description read in conjunction with the accompanying drawings, in which:

FIG. 1 is a side elevational view of a revolver which includes the yoke stud retainer embodying this invention;

FIG. 2 is a front elevational view of the revolver with the cylinder closed;

FIG. 3 is a front elevational view of the revolver with the cylinder open;

Figure 4:
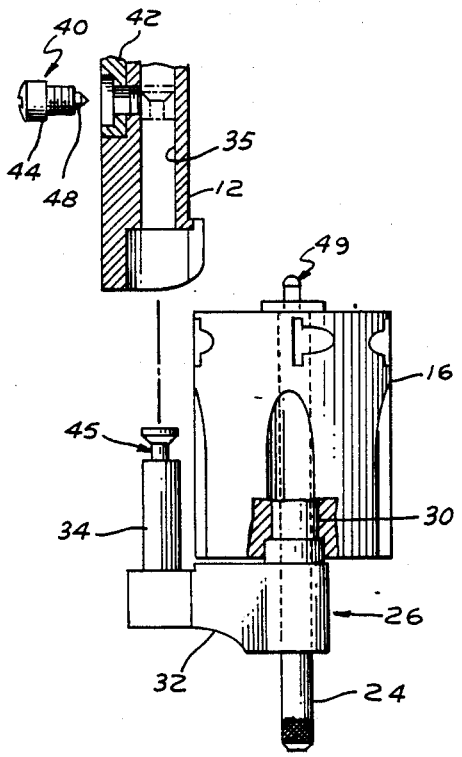
FIG. 4 is a partial exploded sectional view taken along line 4—4 of FIG. 3 illustrating the relationship of the retainer and yoke stud of the cylinder.

A conventional revolver is shown generally at 8 in FIG. 1 and comprises a frame 12 which includes a handle portion 13, and a rectangular opening or window 14 adapted to receive the cylinder 16. The cylinder 16 includes a plurality of longitudinal bores 18 which are adapted to position, in sequence, cartridges (not shown) to the firing position in axial alignment with the barrel 20 and hammer 22. The cylinder is rotatable about its centerline on a center pin 24 and the cylinder, itself, is pivotable on a yoke 26. Upon forward movement of thumb piece assembly 28, a pin within frame 12 is forced against axially aligned pin 49 (FIG. 4) which, in turn, is free to move within tubular shaft 24. As a result, retaining pin 49 is moved forwardly to release the cylinder 16 and enable its pivotable movement on yoke 26 out of window 14 to an "open" position, illustrated in FIG. 3. When the cylinder 16 is "open", as in FIG. 3, the empty brass or cartridge cases may be removed and the cylinder reloaded. It may then be swung back into the window 14 to its "closed" position to ready the pistol for firing.

The yoke 26 comprises a tubular arbor portion 30 on which the cylinder 16 is rotatably mounted and which also houses tubular shaft 24 and pin 49 slidably disposed within shaft 24. The yoke further comprises a cross-head portion 32 and a cylindrical stud 34 which is parallel to arbor 30.

The yoke stud 34 fits into a cylindrical bore 35 in the frame 12 and serves as the center of rotation for pivotable movement of yoke 26 and the cylinder 16 which is carried thereby. The steel cylinder, especially when loaded with the cartridge, is a relatively heavy component and it is desirable to control or dampen its pivotable movement by placing a drag on yoke stud 34. This is one function for unitary spring detent 40 embodying this invention. The detent also serves as a retainer or setscrew for the assembly of the yoke stud on the frame and as a fastener means for securing the separable side plate 42 on the frame 12.

Figure 5:
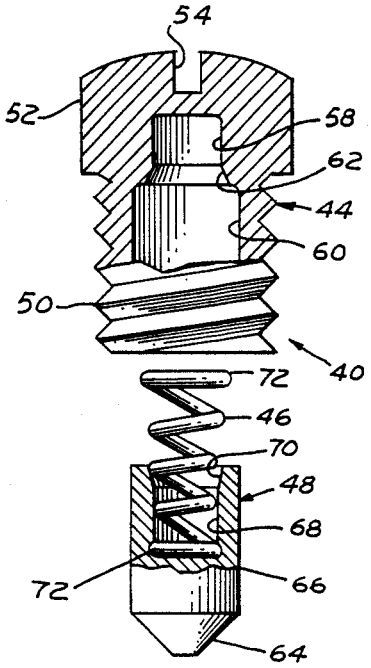
FIG. 5 is an enlarged elevational view partly in cross-section of the retainer.
Figure 6:
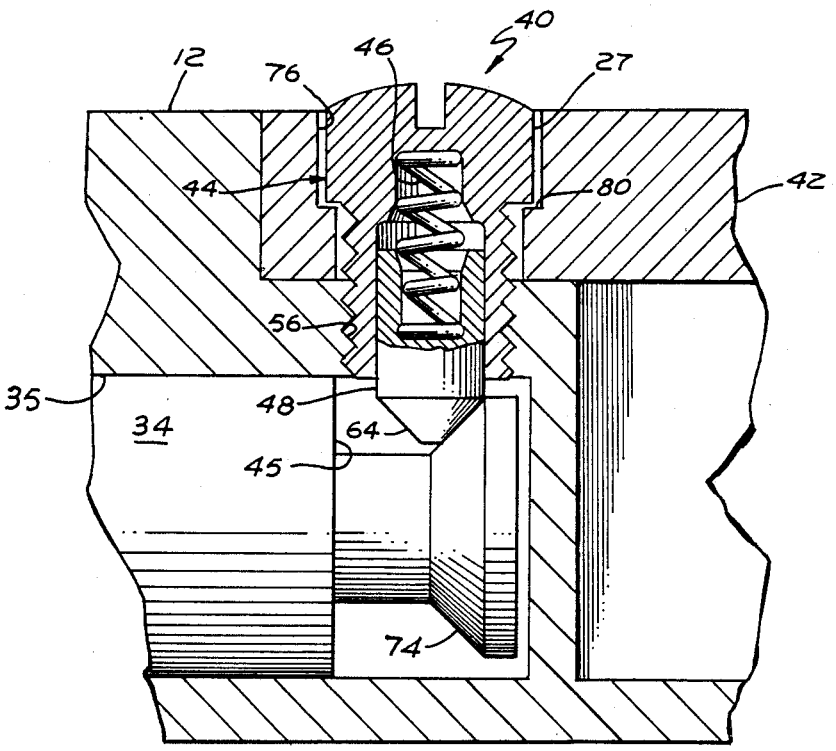
FIG. 6 is an enlarged sectional view similar to FIG. 4, but with the components shown in assembled relation.

The improved retainer 10 embodying this invention is best illustrated in FIGS. 4–6 of the drawing and comprises a screw portion 44, a coil spring 46 and a pin portion 48. The screw 44 includes a threaded shank portion 50 and enlarged head portion 52 with a transverse drive slot 54 adapted to receive the blade of a screw driver for screwing and unscrewing the retainer into and out of the threaded bore 56 in the frame 12. The screw includes an inner cylindrical recess 58 for receiving and securing the inner end of spring 46 therein and an outer recess 60 adapted to accommodate the free reciprocal movement therein of pin 48. A chamfered section 62 interconnects the outer end, inner cylindrical recesses and serves as a guide surface when these parts of the retainer are assembled.

The pin 48 includes a truncated conical tip portion 64 and a cylindrical body portion 66 which has an axial length approximately equal to the corresponding dimension of recess 60. The body portion of pin 48 is provided with a cylindrical recess 68 of the same internal diameter as recess 58. The outer edge of recess 68 is slightly bevelled as at 70 to assist in its assembly with coil spring 46.

The coil spring 46 has an overall length when uncompressed, which is substantially greater than the combined lengths of recess 58, chamfer 62 and recess 68 of the pin. As a result, the spring, when fitted into the screw and pin as shown in FIG. 6, will be subject to substantial compression before the inner end of pin 48 contacts the inner end of recess 60. At each of its outer ends, coil spring 48 has a coil 72 of substantially larger diameter than the internal diameters of recess 58 and recess 68 in the screw and pin, respectively. This dimensioned relationship is such that the spring 46 will serve not only as a spring but as a coupling means which holds the three parts in assembled relation, as in FIG. 6. Assembly of the three discrete components may be accomplished by simply fitting one end of spring 46 into the recess 68 of pin 48 and the opposite end of the spring into the recess 60 of screw 44. By simply manually pressing the pin into the screw, the enlarged coils 72 of the spring will be securely seated in screw 44 and pin 48 to provide a unitary retainer assembly which will remain so for normal assembly and disassembly of the unitary retainer.

The cylindrical stud 34 is provided with an annular groove 45 adjacent the outer end thereof. One surface which defines the groove is chamfered, as at 74, to mate in surface-to-surface contact with the correspondingly bevelled, conical tip 64 of pin 48. The retainer assembly serves in the manner of a set-screw to secure the yoke stud 34 in the bore 35 of frame 12. A spring biased pin also imparts a drag on the pivotable movement of the yoke 26 and cylinder 16 carried thereby. In addition, the retainer 40 assists in fastening side plate 42 in place on the frame, screw 75 also being provided for this purpose. As best illustrated in FIG. 6, the retainer assembly is fitted into a hole 76 through side plate 42 and the threaded outer end 50 of screw 44 is screwed into threaded bore 56 in the frame 12. This assembly step would be carried out with the yoke stud 34 disposed in bore 35 of the frame, as depicted in FIG. 6. The chamfered surface 74 and conical tip 64 will, in case of misalignment of the two parts, exert an axial component of force on pin 48 to compress spring 46 and thereby prevent damage to the pin caused by application of a lateral force to pin 48 whereby the pin might be wedged into a fixed and thus inoperative position in recess 60.

The retainer screw 44 is fitted into frame 12 and screwed down until the undersurface of its head 52 abuts a shoulder 80 provided within hole 76 in side plate 42. The shoulder 80 is located at a depth measured radially from the inner diameter of bore 35 such that when fastened securely in place, the outer end of pin 48 will extend a substantial distance into the bore 35. As a result, the pin will engage the chamfered annular surface 74 of yoke stud 34 and cause spring 46 to be compressed. In this way, the pin is spring biased outwardly and will impart a drag on the rotational movement of yoke stud 34 whenever the cylinder 16 is pivoted into and out of the window 14.

The improved retainer for a revolver yoke stud, as herein described, accomplishes the multiple functions of retaining the yoke stud in its assembled condition, of applying a spring drag on the pivoting motion of the cylinder and of serving as a fastener for the side plate of the pistol frame.

Having thus described my invention, what is claimed is:

1. In a revolver having a yoke stud, a retainer comprising a screw having head and tubular stem portions, a detent pin disposed to move axially within the stem portion of the screw, a coil spring disposed between the pin and screw to bias said pin outwardly, said spring being firmly secured at each end to the screw and pin to form an integral retainer adapted for assembly in the revolver and disassembly thereof as a one-piece structure, said pin being adapted to engage the yoke of the revolver to retain the same in assembled relation in the revolver and to impart a spring biased drag on said yoke stud.

2. In a revolver having a yoke stud, a retainer as set forth in claim 1, in which said pin has an inner end disposed within the screw and an outer end extending outwardly of the screw, said pin further includes an internal recess open at its inner end and said screw includes a first bore adapted to receive said pin for reciprocal movement therein and a second bore of smaller diameter than said first bore, at least one coil on opposite ends of said spring having a diameter adapted for a press-fit with the pin recess and second bore of said screw.

3. In a revolver having a yoke stud, a retainer as set forth in in claim 2, in which the outer end of said pin is generally conical in shape and the yoke stud has an annular groove having at least one chamfered surface adapted to engage in surface-to-surface contact the conical surface of said pin.

4. In a revolver having a yoke stud, and a retainer as set forth in claim 3, in which said revolver has a frame with a separate side plate disposed on one side thereof, and said screw serves as means for fastening the side plate onto said frame.

* * * * *